US008356691B2

(12) United States Patent
Griffith

(10) Patent No.: US 8,356,691 B2
(45) Date of Patent: Jan. 22, 2013

(54) ENERGY ABSORBER FOR PERSONAL FALL ARRESTOR

(75) Inventor: Richard R. Griffith, Utica, NY (US)

(73) Assignee: Sturges Manufacturing Co., Inc., Utica, NY (US)

( * ) Notice: Subject to any disclaimer, the term of this patent is extended or adjusted under 35 U.S.C. 154(b) by 675 days.

(21) Appl. No.: 12/542,809

(22) Filed: Aug. 18, 2009

(65) Prior Publication Data

US 2011/0042165 A1 Feb. 24, 2011

(51) Int. Cl.
*A62B 1/16* (2006.01)

(52) U.S. Cl. ..... 182/3; 182/18

(58) Field of Classification Search ..... 182/3, 18
See application file for complete search history.

(56) References Cited

U.S. PATENT DOCUMENTS

| | | | | |
|---|---|---|---|---|
| 1,603,484 | A | 10/1926 | Meissner | |
| 1,697,833 | A | 1/1929 | Lane | |
| 2,549,841 | A | 4/1951 | Morrow at al. | |
| 2,864,409 | A | 12/1958 | Richter | |
| 2,929,412 | A * | 3/1960 | Abendroth | 139/385.5 |
| 3,444,957 | A * | 5/1969 | Ervin, Jr. | 182/3 |
| 3,804,698 | A * | 4/1974 | Kinloch | 428/176 |
| 3,861,744 | A | 1/1975 | Yamada et al. | |
| 3,978,894 | A | 9/1976 | Boone | |
| 4,253,544 | A | 3/1981 | Dalmaso | |
| 4,618,026 | A | 10/1986 | Olson | |
| 4,670,945 | A | 6/1987 | Banks | |
| 4,856,837 | A * | 8/1989 | Hammersla, Jr. | 294/74 |
| 5,564,476 | A | 10/1996 | Golz | |
| 5,598,900 | A | 2/1997 | O'Rourke | |
| 6,006,700 | A | 12/1999 | Cox | |
| 6,085,802 | A * | 7/2000 | Silberberg | 139/387 R |
| 6,199,597 | B1 | 3/2001 | David | |
| 6,533,066 | B1 * | 3/2003 | O'Dell | 182/3 |
| 6,851,516 | B2 | 2/2005 | Petzl et al. | |
| 7,677,360 | B2 * | 3/2010 | Tanaka et al. | 182/3 |
| 7,815,013 | B2 * | 10/2010 | Griffith | 182/3 |
| 2003/0155177 | A1 | 8/2003 | Petzl et al. | |
| 2006/0027277 | A1 * | 2/2006 | Jennings et al. | 139/408 |
| 2007/0068730 | A1 * | 3/2007 | Griffith | 182/3 |
| 2007/0068731 | A1 * | 3/2007 | Griffith | 182/3 |
| 2008/0179136 | A1 * | 7/2008 | Griffith | 182/5 |

OTHER PUBLICATIONS

Canadian Standards Association; Energy absorbers and lanyards; Z259.11-05; Feb. 2005; 42 Pages.
Canadian Standards Association; Shock Absorbers for Personal Fall Arrest Systems; CAN/CSA-Z259.11-M92 (Reaffirmed 1998); Mar. 1992; 20 Pages.
American Society of Safety Engineers; American National Standard Safety Requirements for Personal Fall Arrest Systems, Subsystems and Components; Z359.1-1992 (R1999); May 1999; 107 Pages.
Yates Gear Inc.; Web Catalog Climbing Equipment 2007 Excerpt; (http://www.vatesgearcom); 1 Page.

* cited by examiner

*Primary Examiner* — Alvin Chin Shue
*Assistant Examiner* — Candace L Bradford
(74) *Attorney, Agent, or Firm* — Hiscock & Barclay, LLP

(57) ABSTRACT

An energy absorber for use in a personal fall arresting system wherein a pair of webbing are held together by tear away binder elements which are arranged to rupture under controlled conditions to prevent failure of the absorber when experiencing high load conditions.

14 Claims, 4 Drawing Sheets

ENERGY ABSORBER FOR PERSONAL FALL ARRESTOR

FIELD OF THE INVENTION

This invention generally involves a break away energy absorber suitable for use in a personal fall arresting system.

BACKGROUND OF THE INVENTION

The American National Standard Institute (ANSI) issued a standard Z359 relating to personal fall arrestor systems in 1992, which was revised in 1999. The standard particularly addressed break away energy absorbers used in most personal fall arrestors that are worn by workers that are required to carry out their work tasks while situated in high places such as scaffolding, window ledges, structural beams and the like. Such workers generally wear a body harness that is secured to an anchorage by a lanyard. In the event of a fall the person in the harness will attain a relatively high velocity in less than one second. Depending upon the length of the lanyard, the descent of the worker, if left unchecked, will terminate abruptly when the lanyard plays out and thus can cause physical harm to the worker. The energy absorbers manufactured to meet the ANSI standard are designed to lessen the force of impact at termination.

One of the break away systems that has been able to meet the ANSI standard is disclosed in U.S. Patent Application Publication 2007/0068730 which involves an energy-absorber having a pair of two ply webbings that are superimposed one on top of the other. The two Interior plys of the superimposed webbings are tied together by interior tear away binding while the exterior plys are tied together by exterior tear away binding. This tear away binder arrangement provides for a clean uniform break away pattern that runs along the parting line separating the two webbing. The binder elements normally rupture at loads that are a little over seven hundred pounds.

Since the issuance of the 1999 ANSI standard, it has been found that the actual tear away loads exerted upon energy absorbers used in personal fall arrestors oftentimes exceeds the expected loads during a fall. The American Society of Safety Engineers (ASSE) is now purposing that energy absorbers be designed to accommodate these higher loads. Tests have shown, however, that these higher loads produce early failures in many tear away energy absorbers. These failures typically manifest themselves in an uncontrolled rupturing of the binder elements such that the break; pattern moves laterally away from the desired parting line separating the two webbings whereupon rapid failure of the absorber ensues.

SUMMARY OF THE INVENTION

It is a primary object of the present invention to improve beak away energy absorbers of the type employed in a personal fall arrestor systems.

It is a further object of the present invention to more closely control the break; away function of a tear away type energy absorber to prevent premature failure of the absorber.

A still further object of the present invention is to reduce the risk of injury to a worker who is required to work at relatively high elevation.

Yet another object of the present invention is to provide a break away energy absorber for use in a personal fail arrestor system that can accept higher than normal loads without failing.

These and other objects of the present invention are attained by a break away energy absorber that includes an upper two ply webbing that is superimposed over a lower two ply webbing such that the assembled webbings includes a pair of longitudinally extended exterior plys and a pair of longitudinally extended interior plys. A series of tear away sections are spaced apart along the length of the absorber which are separated by intermediate control sections. A first continuous exterior binder element connects the two exterior plys running through each tear away section while a second continuous interior binder element connects the two interior plys running through each tear away section. The exterior binder element is further arranged to run through each of the control sections contained within one of the webbings while the interior binder element is similarly arranged to run through each of the control sections contained within the other webbing. The binder elements that are within the webbings of each control section are arranged to connect the face ply of the enclosing webbing with the back ply of the webbing.

BRIEF DESCRIPTION OF THE DRAWINGS

For a better understanding of these and other objects of the present invention, reference will be made to the following detailed description of the invention which is to be read in association with the accompanying drawings, wherein.

DESCRIPTION OF THE INVENTION

Figure 2:
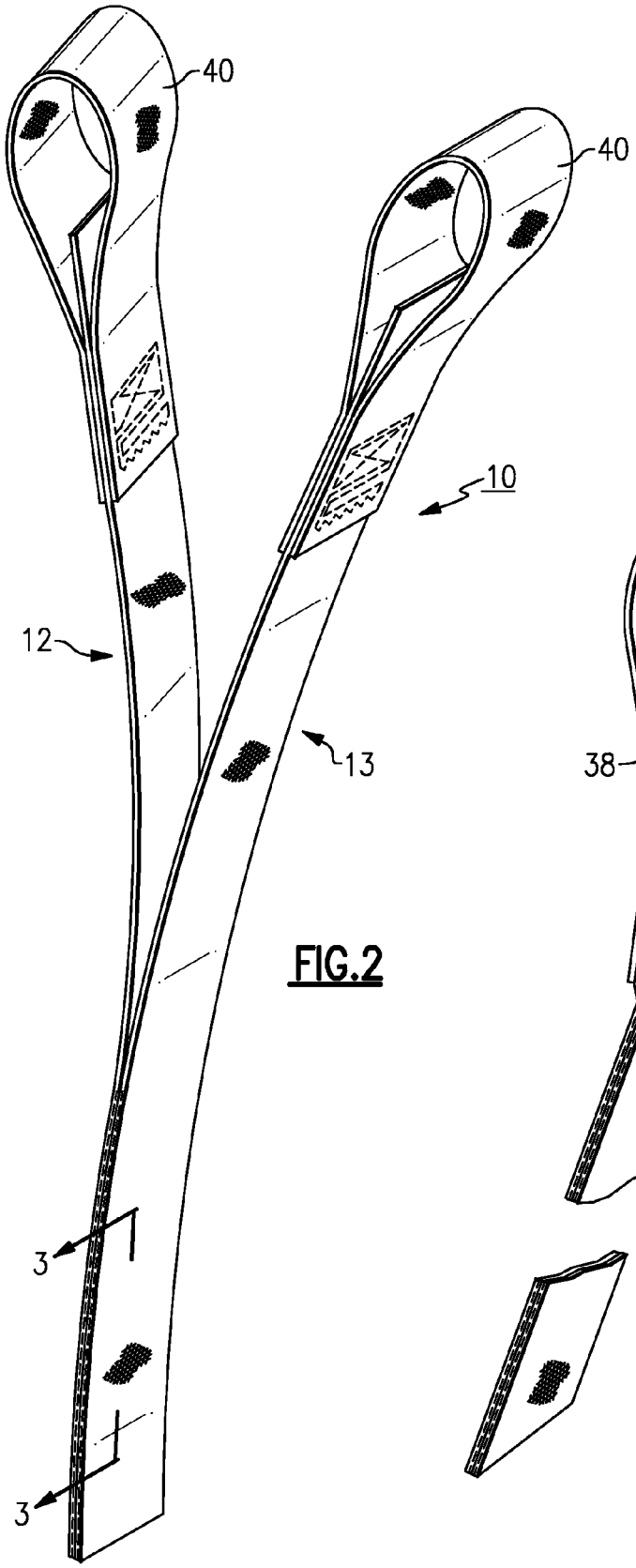
FIG. 2 is a partial perspective view similar to FIG. 1 showing one of the energy absorbers webbings being partially separated from the other webbing.
Figure 1:
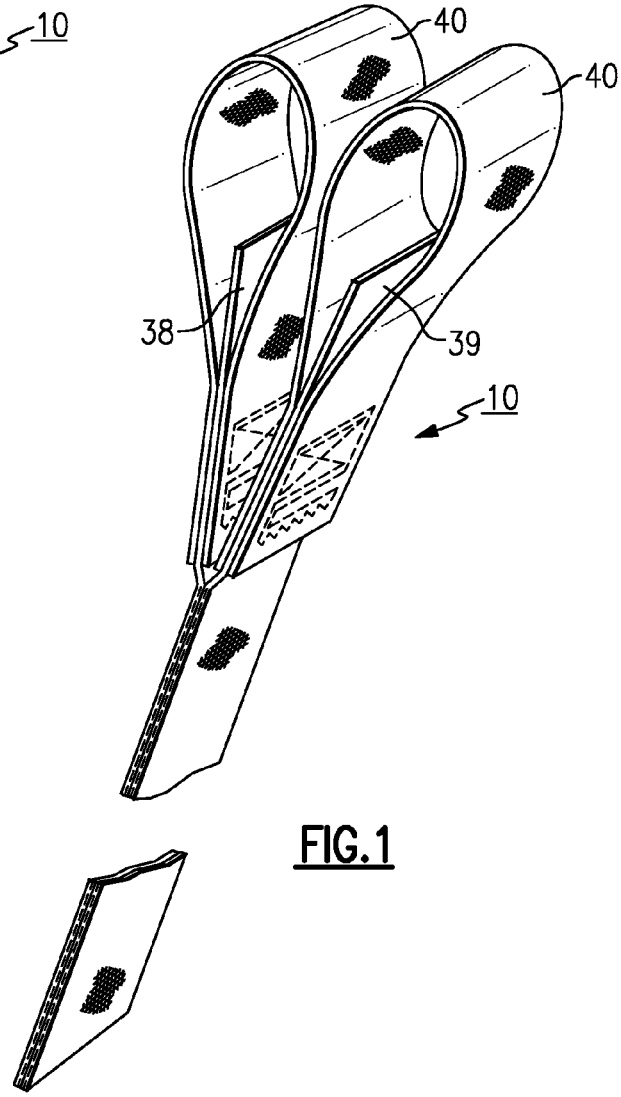
FIG. 1 is a perspective view illustrating a tear away energy absorber suitable for use in a personal fall arrestor system embodying the teachings of the invention.
Figure 3:
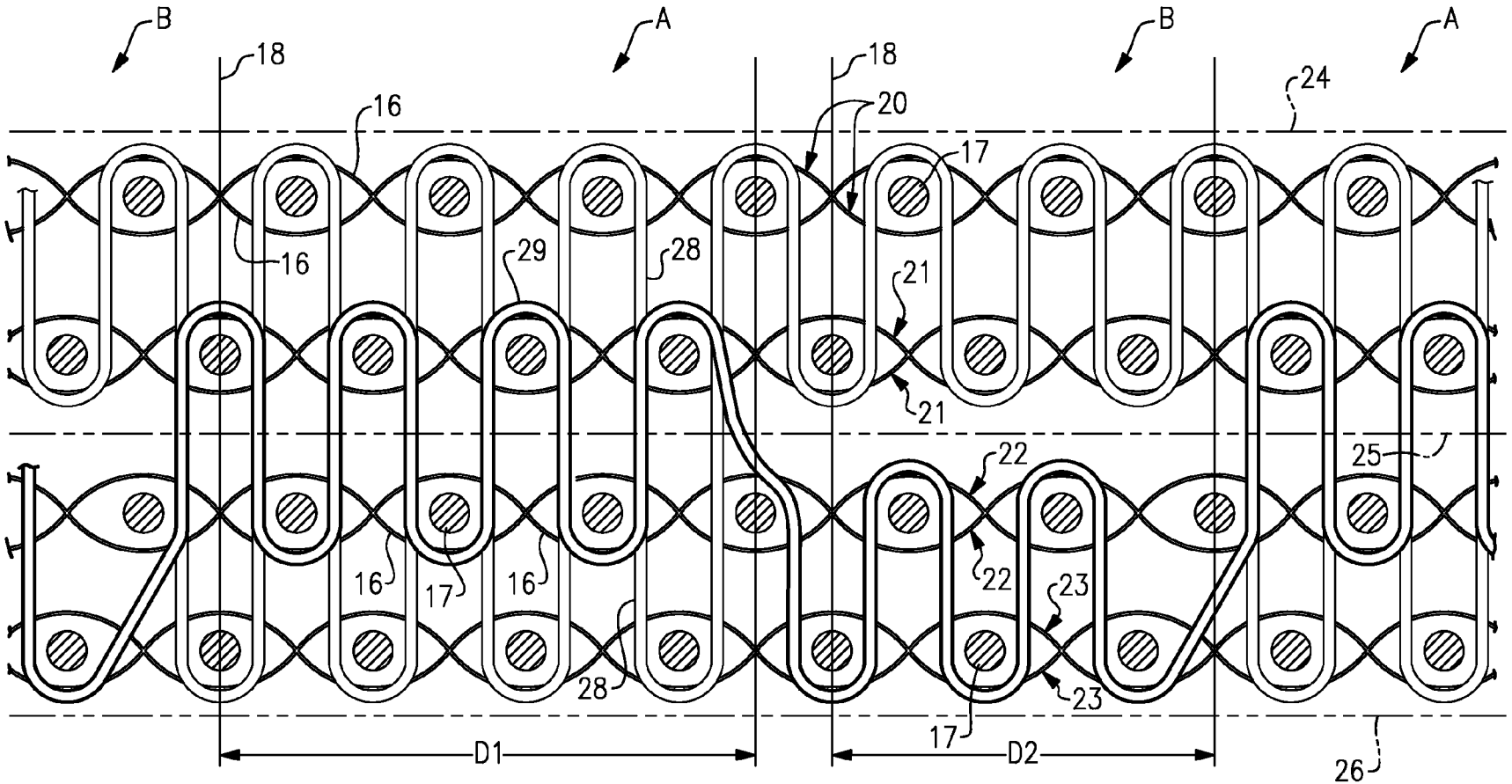
FIG. 3 is an enlarged sectional view taken along lines 3-3 in FIG. 2 further illustrating the internal construction of the energy absorber.

Turning initially to FIGS. 1-3 there is illustrated a tear away type energy absorber, generally referenced 10, that embodies the teachings of the present invention. The absorber includes a pair of two ply webbings which are an upper webbing 12 and a lower webbing 13. As will be explained in greater detail below the webbings are woven of high tenacity polyester yarns with each ply that is enclosed within the webbing containing a pair of continuous longitudinally extend warp ends 16-16 that crisscross around laterally extended weft ends 17-17 that transverse the width of each webbing.

The upper webbing contains a series of laterally aligned face plys 20 and a series of laterally aligned back plys 21 while the lower webbing similarly includes a series of laterally aligned face plys 22 and a series of laterally aligned back plys 23. The weft ends 17-17 that pass through the back plys of each webbing are vertically aligned in columns 18 as are the weft end that pass through the face plys of the two webbings. The upper and lower webbings are of the same length and width. In assembly, however, the vertically aligned face ply columns are centered about midway between the vertically aligned back ply columns.

With further reference to FIG. 3, the longitudinal boundaries of the upper webbing are delineated by phantom lines 24 and 25 and the boundaries of the lower webbing are delineated by commonly shared phantom line 25 and phantom line 26. The commonly shared line 25 represents the line along which the webbings separate when the absorber is actuated during a fall. In assembly, the two webbings are woven tightly together in longitudinal alignment by a pair of continuous binder elements which are herein referred to as the exterior binder element 28 and the interior binder element 29 that extend along the length of the absorber. The absorber is divided along its length into a series of spaced apart tear away sections (A) which are separated by a series of intermediate control sections (B). Within the tear away sections the exterior binder element, is arranged to pass back and forth over the weft, ends situated in the face ply of the upper binding and back ply of the lower binding. Correspondingly, the interior binder element is arranged to pass back and forth over the weft ends of the back ply in the upper webbing and the face ply of the lower webbing.

The binder patterns, however, change as the binder elements pass through the intermediate control sections of the absorber. As illustrated in FIG. 3, the binders are fully contained within one or the other of the two webbing within each control section and are arranged to track over the weft ends of the face plys and back plys of each webbing within each control section.

Tests have shown that tear away energy absorbers of the type herein described fail under high load conditions. At the time of failure, the breakline created by the ruptured tear away binders tends to walk away from the desired parting line that separates the two webbings whereupon failure rapidly ensues. Through experimentation, it has been further found that break away skewing under high load conditions can be prevented by subdividing the length of the absorber into staggered break away segments that are separated by shorter control segments. This binder configuration allows separation of the absorber webbings to take place in a series of uniform energy pulses of relatively short duration so that failure does not occur under high load conditions. Preferably, the length of tear away sections of the binder are between 5 and 6 times longer than the length of the control sections.

The two opposing ends 38 and 39 (FIG. 1) of the energy absorber 10 are provided with connectors 40 for attaching the absorber into a personal fall arrestor system. In this type of system, the absorber is placed in series with a high strength lanyard which couples the workers harness to a suitable anchorage capable of arresting the worker decent in the event of a fall. The lanyard has sufficient length to allow the worker a reasonable amount of freedom to move about. In the event of a fall, the lanyard plays out until it became taut whereupon the energy of the falling load is taken up by the energy absorber as the binders begin to rupture. The rate of fall is thus quickly decelerated to a point where the worker is uninjured during the arresting period.

Figure 4:
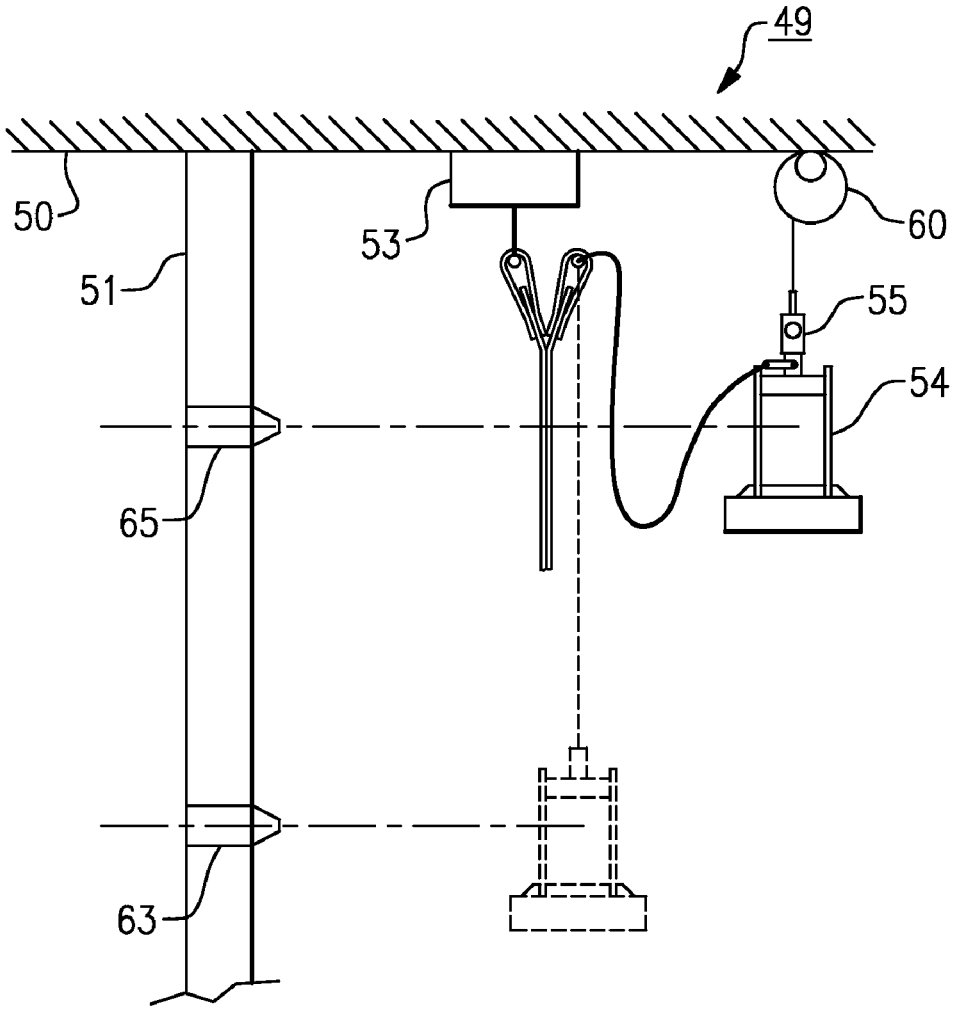
FIG. 4 is a front elevation of a test stand upon which the energy absorber of the present invention was dynamically tested.

Applicant, in order to test its energy absorbers, constructed a test stand 49 which is illustrated in FIG. 4. The energy absorbers being tested were furnished with high strength non elastic loop connectors 40-40 fabricated of a high tenacity polyester yarn having a strength that is greater than that of webbing and binder material. The loops were sewn into the two ends of the absorber so that the connectors were unable to pull out under test loads in excess of one thousand pounds.

The test stand contained an anchorage consisting of a raised horizontal beam 50 supported between a pair of spaced apart vertical columns, one of which is depicted at 51. Although not shown, the cross beam 50 is suspended over a sand filled drop pit. During testing, the two end loops of the energy absorber were each provided with a shackle and one of the shackle was connected to an anchorage point upon the crossbeam. A ten pound weight was temporarily attached to the other loop and the weight then suspended from the beam and the distance between the two loop fold over points was recorded.

A load cell 53 was securely mounted upon the center of the cross beam and one end of the energy absorber during testing was attached to the load cell by an eye bolt. A two hundred and eighty two pound weight 54 was used during testing and was connected to an air activated quick disconnect mechanism 55 by means of a shackle. The weight was then raised by means of an electrical hoist 60 to a point below the crossbeam and the other loop of the energy absorber connected to the lanyard. The weight was then lowered by the hoist until it was supported entirely by the test lanyard. A first laser sensor 63, which is adjustably mounted upon column 51 was adjusted so that its beam illuminated a horizon index line scribe on the weight. A second adjustable laser sensor 65 was set six feet above sensor 63. The weight was again raised until the upper sensor illuminated the index line on the weight thus preparing the stand to perform a dynamic test upon the energy absorber.

At this time, the quick disconnect mechanism was released and the weight allowed to drop thus activating the tear away absorber. The binders in the tear away sections begin to rupture thereby decelerating the fall and any tendency of the break line to skew to one side or the other of the desired parting line was corrected within the control sections where upon a uniform separation of the webbings was produced along the parting line between the webbings to terminate the fall. The distance between the fold over points of the loops was then again measured and the elongation of absorber was calculated and recorded along with the peak, load and average load data which was graphically provided by the load cell read out.

Based upon expected revised ANSI standards, the energy absorber should not elongate beyond forty eight inches from its initially measured length and the average arresting force should remain at or below nine hundred pounds during the arresting period.

A number of test specimens containing the double two ply webbing configuration described above were tested in the test stand in an effort to identify an energy absorber that will consistently meet the expected revised dynamic performance standards for this type of energy absorber. One absorber configuration was identified that consistently meets the expected revised standards. In this configuration each webbing had a length of about 28.0 inches and a width of about 1.96 inches. Each face ply and back ply contained 60 warp ends of 1300 denier two ply high tenacity polyester yarn and weft ends in each ply being fabricated of 1300 denier high tenacity polyester yarn. The interior and exterior binders contained 29 ends and were fabricated of 1,000 denier high tenacity polyester yarn.

Figure 5:
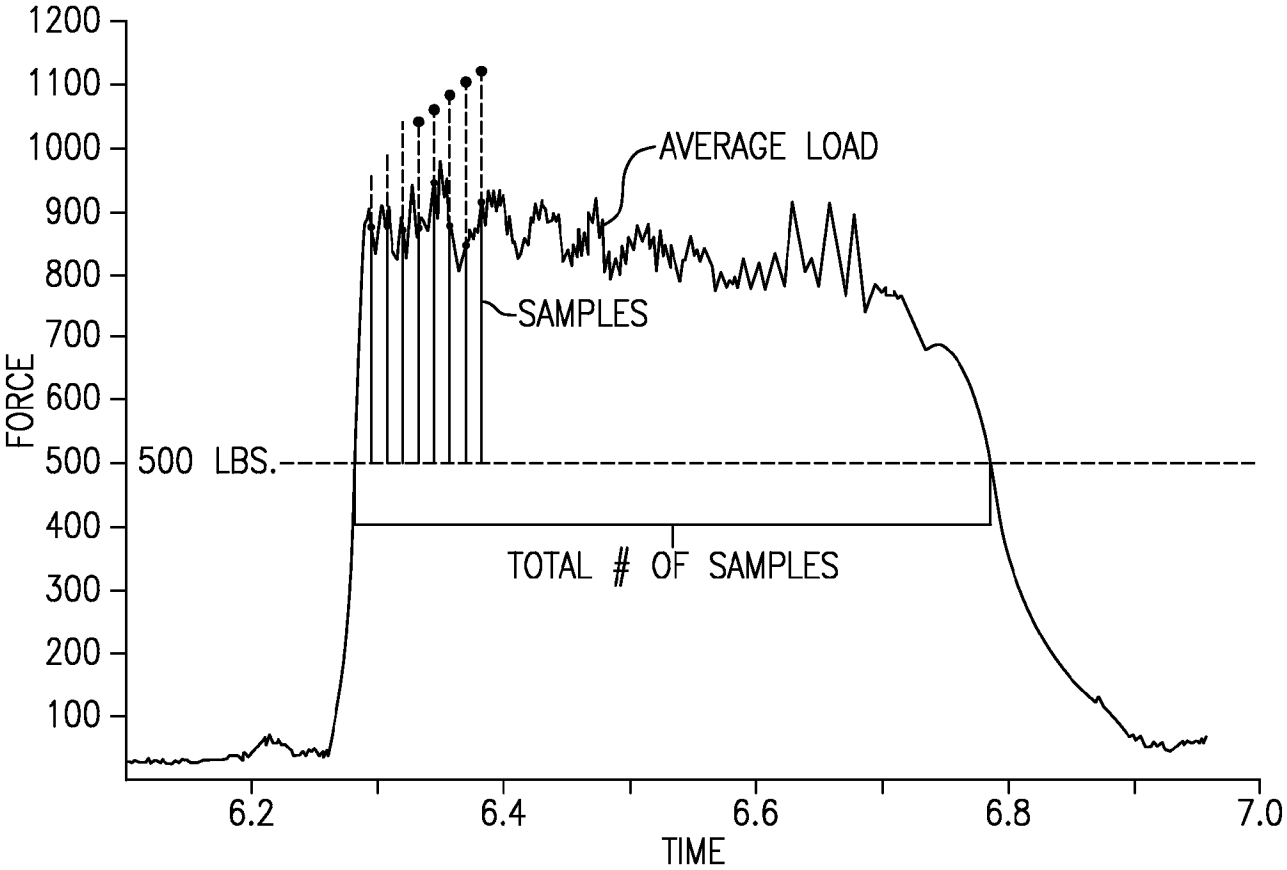
FIG. 5 is a graph showing the results of a dynamic test that was conducted upon a test specimen embodying the present invention in which load is plotted against time.

FIG. 5 is a graphic representation of an acceptable energy absorber that was tested as noted above. The test was conducted with the relative humidity at a moderate level and the ambient temperature above 60° F. The graph plots load in pounds exerted upon the specimen against time. The specimen elongated about 48 inches with an average load just under 900 pounds. As can be seen from the graph, the curve is generated by a series of short duration pulses that are generated as the rupturing takes place within each tear away section.

It was also found through testing that the performance of the present energy absorber was further enhanced by coating the binders as well as the warp and weft ends with an abrasion and moisture resistant material such as a siloxane-based material that is available from Performance Fibers, Inc. under the trade name SEAGUARD as well as protecting against yarn to yarn wear.

While the invention has been described with reference to a preferred embodiment, it will be understood by those skilled in the art that various changes may be made and equivalents may be substituted for elements thereof to adapt to particular situations without departing from the scope of the invention. Therefore, it is intended that the invention not be limited to the particular embodiments disclosed as the best mode contemplated for carrying out this invention, but that the invention will, include all embodiments falling within the scope and spirit of the appended claims.

What is claimed is:

1. An energy absorber for use in a personal fall arrestor, said energy absorber comprising:

an upper two-ply webbing and a lower two-ply webbing, each of said upper and lower webbings containing a face ply and a back ply that extends along the length of said energy absorber;

said upper two-ply and said lower two-ply webbing being mounted one over the other with the back ply of said upper webbing positioned adjacent to the face ply of said lower webbing;

a number of tear away sections staggered along said length of said energy absorber which are separated by intermediate control sections; and exterior tear away binder elements and interior tear away binder elements extending continuously along the length of said energy absorber;

in which said exterior tear away binder elements are arranged to run back and forth between attachment points located upon the face ply of the upper two-ply webbing and the back ply of said lower webbing in each of said tear away sections and between the face ply and the back ply located in one of said upper and lower webbings in each of said intermediate control sections; and said interior binder elements being arranged to run back and forth between attaching points located upon the back ply of the upper two-ply webbing and the face ply of the lower two-ply webbing in each of said tear away sections and between the face ply and back ply located in the other of said webbings in each of said intermediate control sections.

2. The energy absorber of claim 1 wherein said tear away sections have a greater longitudinal length than said intermediate control sections.

3. The energy absorber of claim 2 wherein the length of each tear away section is between about 5 and 6 times as long as that of each intermediate control section.

4. The energy absorber of claim 1 wherein said binder elements ends contain a coating for protecting against yarn to yarn frictional wear, temperature extremes and moisture damage.

5. The energy absorber of claim 4 wherein said protective coating is a siloxane based material.

6. The energy absorber of claim 1 wherein each of said binder elements and said weft ends and warp ends are fabricated of a high tenacity polyester yarn.

7. An energy absorber for use in a personal fall arrestor system that includes:

a two ply upper webbing and a two ply lower webbing each containing a face ply and a back ply that have continuous warp ends that extend longitudinally along the length of said absorber and uniformly spaced weft ends that pass laterally through said warp ends;

said upper and lower two-ply webbings being mounted one on top of the other such that the back ply of the upper two-ply webbing are contiguous with the face ply of the lower two-ply webbing with the weft ends of the back ply being located about midway between said weft ends of the face ply;

tear away sections staggered along the length of said absorber that are separated by intermediate control sections;

a series of continuous tear away exterior binder elements that pass back and forth over said weft ends contained in said face ply of the upper two-ply webbing and said weft ends contained in said back ply of the lower two-ply webbing within each tear away section and back and forth between said weft ends of the face ply and back ply of a first webbing within each of the intermediate control sections; and a series of continuous tear away interior binder elements that pass back and forth over said weft ends contained in said back ply of said upper two-ply webbing and said weft ends contained in said face ply of said lower two-ply webbing within each of said tear away sections and between said weft end in the face ply and back ply of a second webbing within each of said intermediate control sections.

8. The energy absorber of claim 7 wherein said tear away sections have a greater length than each said control section.

9. The energy absorber of claim 8 wherein the length of each tear away section is between about 5 and 6 times greater than that of said control sections.

10. The energy absorber of claim 7 wherein said binder elements and said weft and warp ends each contain a coating for protection against yarn to yard frictional wear, temperature extremes and moisture damage.

11. The energy absorber of claim 10 wherein said protective coating is a siloxane based material.

12. The energy absorber of claim 7 wherein each said binder element and each of said weft and warp ends are fabricated of a high tenacity polyester yarn.

13. The energy absorber of claim 7 where each ply contains about 60 face ends or about 60 back ends.

14. The energy absorber of claim 13 wherein said face and back warp ends are fabricated of 1300 two ply high tenacity polyester yarn and the weft is fabricated of 1300 denier polyester yarn and said binder elements are fabricated of 1000 denier high tenacity polyester yarn.

* * * * *